US007520973B2

(12) United States Patent
Matejat et al.

(10) Patent No.: US 7,520,973 B2
(45) Date of Patent: Apr. 21, 2009

(54) METHOD FOR REGENERATING ETCHING SOLUTIONS CONTAINING IRON FOR THE USE IN ETCHING OR PICKLING COPPER OR COPPER ALLOYS AND AN APPARATUS FOR CARRYING OUT SAID METHOD

(75) Inventors: Kai-Jens Matejat, Oberkrämer (DE); Sven Lamprecht, Oberkrämer (DE)

(73) Assignee: Atotech Deutschland GmbH (DE)

( * ) Notice: Subject to any disclaimer, the term of this patent is extended or adjusted under 35 U.S.C. 154(b) by 152 days.

(21) Appl. No.: 10/559,396

(22) PCT Filed: Jun. 7, 2004

(86) PCT No.: PCT/EP2004/006115

§ 371 (c)(1),
(2), (4) Date: Apr. 3, 2006

(87) PCT Pub. No.: WO2004/111308

PCT Pub. Date: Dec. 23, 2004

(65) Prior Publication Data

US 2006/0175204 A1 Aug. 10, 2006

(30) Foreign Application Priority Data

Jun. 13, 2003 (DE) ..... 103 26 767

(51) Int. Cl.
*C02F 1/46* (2006.01)

(52) U.S. Cl. ..... 205/687; 205/704; 205/741; 205/743; 204/272; 204/275.1

(58) Field of Classification Search ..... 205/687, 205/704, 741, 743; 204/272, 275.1
See application file for complete search history.

(56) References Cited

U.S. PATENT DOCUMENTS 3,784,455 A 1/1974 Parikh et al.
3,825,484 A 7/1974 Fronsman et al.
3,933,606 A * 1/1976 Harms ..... 205/743

(Continued)

FOREIGN PATENT DOCUMENTS

EP 0 794 269 6/2002

(Continued)

OTHER PUBLICATIONS

William H. Parker, (1966) "Renegenerating Ferric Sulfate Etch Baths", *Metal Program*, 89(5):133-134.
"Handbuch der Leiterplattentechnik", *Leuze Verlag*, (1982), pp. 168-170.

(Continued)

*Primary Examiner*—Arun S Phasge
(74) *Attorney, Agent, or Firm*—McDonnell Boehnen Hulbert & Berghoff LLP

(57) ABSTRACT

A method for the regeneration of etching solutions containing iron for the use in etching or pickling copper or copper alloys and an apparatus for carrying out the method is described. The method involves feeding the etching solution to be regenerated from the etching system into an electrolysis cell being hermetically sealed or having an anode hood (8), the electrolysis cell comprising a cathode (1), an inert anode (2), means (3) for removing the electrolytically deposited copper from the cathode and means (4) for collecting the removed copper and applying a potential to the removed copper, wherein the electrolysis cell does not have an ion exchange membrane or a diaphragm.

10 Claims, 3 Drawing Sheets

U.S. PATENT DOCUMENTS

| | | | | |
|---|---|---|---|---|
| 4,265,722 | A | | 5/1981 | Faul et al. |
| 4,604,175 | A | * | 8/1986 | Naumov et al. ..... 205/750 |
| 4,880,495 | A | | 11/1989 | Petraitis et al. |

FOREIGN PATENT DOCUMENTS

| | | | |
|---|---|---|---|
| JP | 51119632 | A | 10/1976 |
| JP | 52146702 | | 12/1977 |
| JP | 552763 | | 1/1980 |
| WO | WO 00/26440 | A | 5/2000 |
| WO | WO 00/26440 | A2 | 5/2000 |

OTHER PUBLICATIONS

User Manual of FA. Dr. Lange: DR 2800 Spectrophotometer, Working Procedures, (2005) Edition 1, "Alachlor" (8 pp), "Iron, Ferrous" (6 pp).

User Manual of Fa. Metrohm: Potentionmetric Titration, The Metrohm Instrument Program, pp. 10-26.

* cited by examiner

METHOD FOR REGENERATING ETCHING SOLUTIONS CONTAINING IRON FOR THE USE IN ETCHING OR PICKLING COPPER OR COPPER ALLOYS AND AN APPARATUS FOR CARRYING OUT SAID METHOD

This application is a National Stage of International Application No. PCT/EP2004/006115, filed Jun. 7, 2004, which claims priority to German Application No. DE 103 26 767.0, filed Jun. 13, 2003.

BACKGROUND OF THE INVENTION

The present invention relates to a method for regenerating etching solutions containing iron for the use in etching or pickling copper or copper alloys and an apparatus for carrying out said method.

1. Field of the Invention

An important step in the treatment of surfaces made of copper or copper alloys is the step of etching or pickling.

2. Description of the Related Art

Especially in the production of printed circuit boards, a plurality of etching steps is necessary. For example, in order to structure the conductor paths the printed circuit board is coated with a photoresist, subsequently exposed and developed in such a way that the copper areas being thus set free can be removed using suitable etching methods. These etching methods are known for a long time in the field of producing printed circuit boards. In "Handbuch der Leiterplattentechnik", Leuze Verlag, 1982, it is described, for example, that etching solutions comprising $FeCl_3$ or $CuCl_2$ are used because the corresponding etching rates are in the range of about 35 μm/min.

The chemical equation $Cu+2FeCl_3 \rightarrow CuCl_2+2\ FeCl_2$ demonstrates that ferric chloride oxidises Cu, which is subsequently dissolved in the form of $Cu^{2+}$.

Generally, in these etching methods for structuring printed circuit boards, copper layers having a thickness of 15 to 40 μm or more are removed thereby increasing the concentration of copper while consuming Fe(III) and, correspondingly, decreasing the etching rate. In order to maintain a constant etching rate, a system is necessary which continuously feeds fresh etching solution during the operation in order to redose the concentration of Fe(III). However, this is only possible until a certain concentration of copper in the etching solution is reached. Therefore, a certain amount of the spent solution is permanently discharged to ensure a continuous operation. By means of this "feed-and-bleed" method, a constant ratio of the concentration of Fe(III) to the concentration of copper is established in the etching solution. Using $FeCl_3$, $CuCl_2$ is formed in the bath dissolving copper as well. Since two elements effective in etching are present in the solution, the redox potential of the solution is measured to control the feeding and the feeding is adjusted to the local requirements. However, this results in a high consumption of the etching solution and the spent solution has to be collected outside the treatment chamber.

For the regeneration of the etching medium the copper has to be removed from the solution. Because of the high concentration of copper in the solution a method can suitably be used wherein copper is electrolytically deposited on a cathode. Thereby, chlorine gas is formed in turn at the anode leading to strict environmental and security restrictions. Furthermore, due to the high concentration of copper, a very high current density is necessary to remove a sufficient amount of copper from the solution. Therefore, the etching solutions are recycled on industrial scale because a local application at the production site for printed circuit boards is thus not economic. Additionally, the $Fe(II)Cl_2$ being present has to be further re-oxidised to $Fe(III)Cl_3$. This is carried out under significant technical efforts by adding chlorine gas to the spent etching solution, thereby forming $FeCl_3$.

Besides the removal of complete copper layers also methods being directed to the treatment of surfaces are applied in the production of printed circuit boards. Thereby, only a few micrometers are removed from the copper surface to prepare the copper surface for the consecutive process in an ideal way. These solutions are mostly referred to as microetching solutions.

Also for cleaning the material to be treated before the metallization a so-called etching cleaner is normally used. Oxidative etching media are also employed in demetallizing Cu and its alloys in various process steps. However, the etching rate of the methods described above is too high for this purpose. Furthermore, they are highly corrosive resulting in a direct oxidation of the surface treated in the presence of atmospheric oxygen.

Thus, other etching media having an etching rate of about 1 μm/min are used for treating surfaces. The most commonly used media are, for example, sodium persulfate (NaPS), caroate ($KSO_5$) or other persulfates in acids such as sulphuric acid, phosphoric acid or methane sulfonic acid (MSA) and combinations thereof as well as $H_2O_2/H_2SO_4$.

Due to the current requirements in the field of printed circuit boards concerning high frequencies and the related control of impedance there is an increased search for novel methods ensuring an economic production at the same or at a higher quality level. Thereby, also processes enabling a sequential build-up (SBU) of a multi-layer circuit board are examined. The use of microetching will be increased thereby. In order to keep the costs low and, if necessary, to satisfy environmental restrictions, it is necessary to provide suitable recycling systems to minimize the formation of waste water.

Etching media consisting of $H_2O_2$ and acids exhibit the problem of a limited operating life because the concentration of Cu increases and $H_2O_2$ is consumed by reduction. On the one hand, the copper can be recycled by freezing-out, on the other hand, copper sulfate that has to be further treated requiring an increased energy demand is obtained. A method for regenerating $H_2O_2/H_2SO_4$ by cristallization is disclosed, for example, in U.S. Pat. No. 4,880,495.

Etching solutions based on NaPS are normally discarded at that time, when a critical copper concentration has been reached. Leading to an increased mass treatment of waste water.

If etching media containing iron such as $FeSO_4/Fe_2(SO_4)_3$ or $Fe(NH_4)_2(SO_4)_2$ or $FeCl_3$ are used, the etching rate is significantly impacted by the concentration of Fe(III). However, Fe(III) is reduced to Fe(II), when the material to be treated having a copper coating, is pre-treated or etched and Cu(II) is dissolved. Normally, the etching solution is discarded at that time, when a specific concentration of Cu has been reached, and has to be freshly prepared.

Several methods for regenerating etching solutions containing iron using an electrolysis cell have already been suggested:

U.S. Pat. No. 4,265,722 describes a method wherein copper from an etching solution is transferred into an electrolysis cell separated from the treatment chamber in order to reenrich the oxidising agent and to deposit copper on the cathode. However, it is pointed that using $FeCl_3$ is not suitable because chlorine gas is formed at the anode which can be avoided by keeping the ratio of Cu(I) and Cu(II) within narrow limits. Furthermore, very high current densities are necessary and Cu is deposited in form of a sludge. Moreover, $CuCl_2$ and $FeCl_3$ are highly aggressive towards conventional materials a treatment chamber is made up off. Therefore, the use of etching solutions free of Cl ions is suggested. $Fe_2(SO_4)_3$ is used therefor and also iron oxide, iron carbonate and iron ammonium sulfate are mentioned. Thus, only oxygen is developed at the anode which is released to the environment. The development of oxygen can also be inhibited by using low current densities. However, to increase the etching rate electrically conductive graphite and activated carbon powders are admixed to the solution which have been treated at high temperatures preliminarily in a complex way. These particles are charged at the anode and assist the chemical etching of copper electrochemically. The anode consists of graphite tube and is surrounded by a diaphragm or an ion exchange membrane. The etching solution flows through the interior of the anode where the oxidising agent is re-enriched. Simultaneously the solution reaches the cathode region through pores in the graphite tube where copper is subsequently deposited at the cathode.

In WO 00/26440 a method is described, wherein a sulphuric iron solution for pickling copper and copper alloys is treated with or without peroxodisulfate after pickling in an electrolysis cell separated from the treatment cells and is subsequently lead back into the pickling bath.

Therein, the dissolved copper is cathodically deposited in the electrolysis cell and Fe(II) is anodically re-oxidised to Fe(III). However, in this method a strict separation of the solution in the catholyte and in the anolyte is required, because otherwise Fe(III) formed at the anode is electrochemically reduced to Fe(II) at the cathode. Moreover, the system can only be operated using low current densities to avoid the development of $O_2$ which is released to the environment reducing the oxidative etching effect of the medium. Thus, several cells of that kind are required for a fixed volume. The separation of anolyte and catholyte is achieved by ion exchange membranes or porous diaphragms also in this case. Diaphragms or membranes have a limited lifetime. Additionally, the electric resistance is significantly increased during the electrolysis leading to further expenses for rectifiers and electric power. The feeding of the regenerated pickling solution is a result of the redox potential required in the treatment chamber.

W. H. Parker describes in Metal Program, V. 89, No. 5, May 1966, 133-134 the regeneration of ferric sulfate etch baths. Therein, $Fe^{2+}$ is oxidised to $Fe^{3+}$ at the anode. A perm selective membrane is provided to avoid the migration of iron ions to the cathode at which they would be reduced.

The examples mentioned above describe a strict separation of the solution in the catholyte and in the anolyte because Fe(III) formed at the anode is electrochemically reduced to Fe(II) at the cathode and the efficiency of the copper deposition is significantly reduced thereby. The example mentioned above also describe open circular systems from which inter alia the oxygen formed at the anode is released and is thus no longer available for the equilibrium reaction.

SUMMARY OF THE INVENTION

The object underlying the preset invention is to provide a method for regenerating etching solutions containing iron which can be carried out in a compact electrolysis cell without a complex separation between the anolytes and the catholytes by diaphragms or ion exchange membranes.

The subject of the present invention is a method for regenerating etching solutions containing iron for the use in etching or pickling copper or copper alloys comprising the following steps:

(i) transferring the etching solution from the etching system into an electrolysis cell being hermetically sealed or having an anode hood (8), the electrolysis cell comprising an inert anode (2), a cathode (1), means (3) for removing the electrolytically deposited copper from the cathode and means (4) for collecting the removed copper and for applying a potential thereto, wherein the electrolysis cell does not comprise an ion exchange membrane or a diaphragm, (ii) electrolytically depositing the copper comprised in the etching solution at the cathode (1), (iii) oxidising Fe(II) comprised in the etching solution to Fe(III) at the anode (2), (iv) removing the copper deposited at the cathode (1), (v) applying a potential to the removed copper to permit a re-dissolving of the copper and (vi) returning the etching solution being thus treated into the etching system.

Basically, any etching media containing iron can be regenerated using the method according to the present invention. Such etching solutions are known per se by the person skilled in the art and are described, for example, in "Handbuch der Leiterplattentechnik", Leuze Verlag, 1982, in U.S. Pat. No. 4,265,722, in WO 00/26440 and in EP 794 69.

For example, $FeCl_3$ is present in an iron(III) chloride etching medium in a concentration of 300 to 450 g/l and HCl in an amount of 100 ml/l (32%). With this etching medium an etching rate of up to 50 μm/min is achieved at a temperature of 20 to 55° C. Fe(III) (such as $Fe_2(SO_4)_3$) in a concentration range of 1 to 60 g/l and $H_2SO_4$ in a concentration range of 60 to 250 g/l at a temperature of 20 to 55° C. are most commonly used as an iron(III) sulfate etching medium achieving etching rates of 0.1 to 1.5 μm/min.

Surfactants such as polyethyleneglycol or polypropyleneglycol are further added in most cases to achieve an improved wetting of the copper and, thus, to achieve a more uniform etching performance.

The method according to the present invention has the significant advantage that no complex separation using a diaphragm or an ion exchange membrane in the electrolysis cell has to be carried out.

Small anode surfaces are preferably used in the method according to the present invention, which are smaller than the cathode surface, because the gas being developed at the anode assists the oxidation of Fe(II) to Fe(III), if the process is controlled in a suitable way.

The method according to the present invention enables to maintain a constant concentration of Fe(III) in the treatment cell and to make the etching solution free of copper resulting in the possibility to achieve a constant etching rate.

BRIEF DESCRIPTION OF THE DRAWINGS

The present invention is further illustrated below with reference to FIG. 1.

DESCRIPTION OF THE PREFERRED EMBODIMENTS

Figure 1:
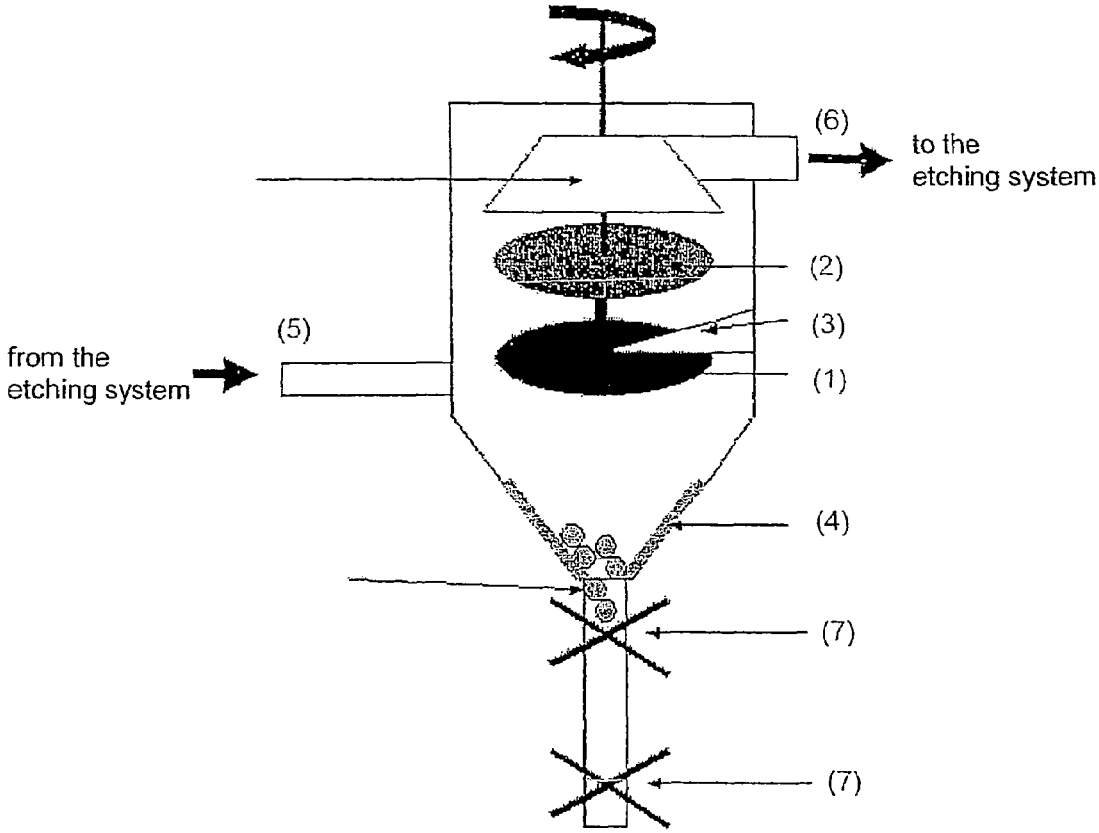
FIG. 1 shows a schematic representation of an apparatus for carrying out the method according to the present invention.

FIG. 1 schematically illustrates the apparatus according to the present invention for the regeneration of etching solutions containing iron. It comprises a separate, hermetically sealed electrolysis cell having a cathode (1) and an inert anode (2), means (3) for removing copper electrolytically deposited at the cathode, means (4) for collecting the removed copper and applying a potential to the removed copper, an inlet (5) provided in the lower part of the electrolysis cell between the cathode (1) and the means (4) for collecting the removed copper and for applying a potential to the removed copper and an outlet (6).

The anode (2) preferably consists of a mixed titanium oxide or is coated with platinum.

The cathode (1) is provided with a means (3) for removing the electrolytically deposited copper. For example, the cathode can be in the form of a rotating electrode provided with a stripping plate.

Thus, the copper deposited at the cathode can be removed and collected by suitable measures. In this connection, the electrolysis cell comprises means (4) for collecting the copper stripped off the cathode such as a collecting hopper provided under the cathode, whereby an electric potential has to be applicable to the collecting means. The means (4) can be, for example, an electrically conducting collecting hopper or a conducting collecting tray.

An essential feature of the method according to the present invention is that the etching solution to be regenerated contacts the cathode of the electrolysis cell first: Accordingly, an inlet (5) is provided in the lower part of the electrolysis cell between the cathode and the collecting means (4). The copper comprised in the etching solution is thereby deposited at the cathode, while Fe(II) comprised in the solution is oxidised to Fe(III) at the inert anode. Thereby, the copper is removed from the etching solution and Fe(III) ions are added thereto. The thus regenerated etching solution is returned to the etching system via an outlet (6).

The copper deposited at the cathode is collected in a collecting means (4) and can be discharged from the electrolysis cell via appropriate valves (7). A suitable potential is applied to the copper via the conducting collecting hopper or the conducting collecting tray to avoid re-dissolving of the copper. The potential should be higher than 0.35 V to avoid re-dissolving.

The flow of the etching solution to be regenerated through the electrosis cell can be controlled by on-line measurement of the Fe(II)/Fe(III) concentration or by on-line measurement of the copper concentration.

The relevant methods for determining the concentrations such as photometric methods or potentiometric measurements are known per se to those skilled in the art and are described, for example, in user manuals of Fa. Dr. Lange in the case of photometry and Fa. Metrohm for the use of potentiometric measurements, respectively.

Figure 2:
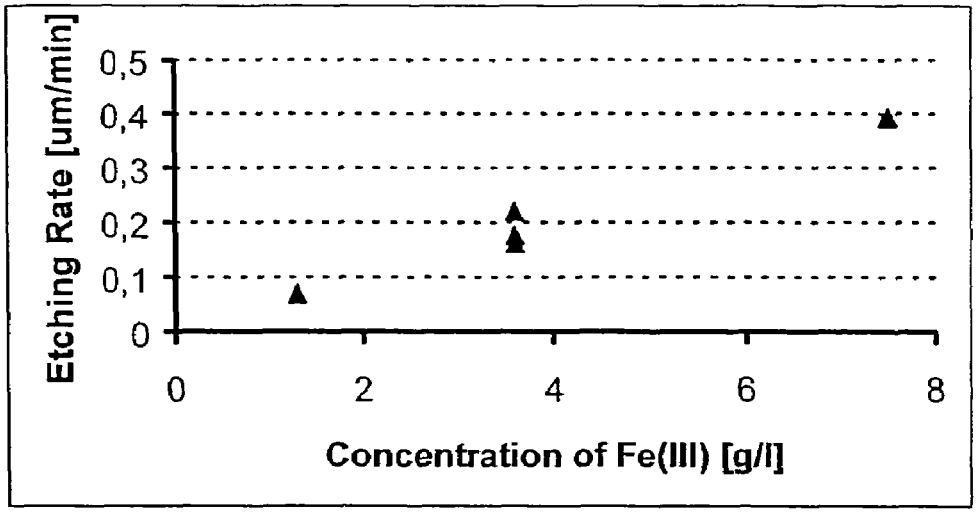
FIG. 2 shows a schematic representation of the etching rate as a function of the concentration of Fe(III).

As indicated above, the etching rate depends on the concentration of Fe(III). The experiments carried out in a volume of 560 l demonstrated that etching rates between 0.1 μm/min. and 0.4 μm/min can be achieved if the concentration of Fe(III) is adjusted between 1.3 g/l and 7.5 g/l as indicated in FIG. 2.

Modern production sites predominantly use etching facilities enabling to move a flat material to be treated horizontally through the treatment liquid. The following explanations correspondingly apply to vertical facilities. For the purpose of demonstrating the efficiency of the apparatus according to the present invention, a horizontally operated etching system is assumed that is able to move a flat material to be treated, such as a printed circuit board, at a speed of 2 m/min through said system. In this example, the volume of the etching solution is 560 litres.

A copper surface of 120 $m^2$ can be treated within one hour using said system whereby 1 μm is removed from this surface. This means that 560 l of etching solution receive about 1068 g of copper during this time. However, Fe(III) is oxidised to Fe(II), thereby impacting the etching rate.

Therefore, Fe(III) is produced by the apparatus according to the present invention to remain within the fixed process range, i.e., to achieve fixed values for the contents of Fe(III) and Cu(II).

The treatment solution charged with copper and having a reduced concentration of Fe(III) contacts the cathode first. Subsequently, two competitive processes occur there. On the one hand, copper is deposited at the cathode and, on the other hand, Fe(III) still present is reduced to Fe(II). Thereby, the efficiency of the copper deposition, i.e., the ratio of the charge carrier provided and the amount of copper actually deposited, becomes less than 100%. The dominating processes and, consequently, the control of the efficiency depends on the copper concentration in the solution, the approach flow of the solution to the cathode and the cathodic potential.

The efficiency is within the range of 0 to 90%, depending on the cathodic potential and the cathodic current density, respectively. If the copper concentration differs too much from the desired value, a low cathodic efficiency is achieved, resulting in an increasing copper concentration. In this case, Fe(III) is reduced at the cathode, leading to a further increased content of Fe(II). When the copper concentration reaches the desired value, an equilibrium between the copper deposition and the cathodic reduction of Fe(III) establishes, resulting in a cathodic efficiency of 60 to 80%.

In the further course, the charged etching solution flows to the anode. If the copper concentration has not yet reached the desired value, the efficiency of the regeneration of the oxidising agent at the anode is already 100%, so that the constant concentration of Fe(III) accompanied by a constant etching performance is achieved. At low potentials Fe(II) is oxidised to Fe(III) at the anode first. However, if there is not enough Fe(II) available at the anode, the development of a gas, such as oxygen, occurs additionally in the case of using a solution free of chlorine. In order to avoid a depletion of Fe(II) close to the anode, the volume flow continuously feeding Fe(II) has to be increased.

If the solution contains too much Fe(II), the anodic current density has to be increased to oxidise a sufficient amount of Fe(II) per time unit. This can result in an increase in the anodic potential. However, the gas development (such as oxygen) occurs at the anode at higher potentials.

It is an advantage of the apparatus according to the present invention that the plating cell is within a closed system from which the gas (such as oxygen) cannot escape, resulting in the dissolved gas supporting the oxidation of Fe(II) to Fe(III) and assisting to adjust the concentration of Fe(II) to the desired value. For safety reasons, an overpressure valve is provided for the case of a too vigorous gas development, through which an excess of oxygen can escape.

For example, it follows from an efficiency of 80% that about 10 A are necessary to remove about 9.5 g copper from the solution within one hour. Correspondingly, 1000 A are needed to deposit about 950 g copper. For depositing usually current densities of 1 to 40 A/dm$^2$ are desired, preferably 10 to 25 A/dm$^2$, specifying the surface of the cathode. The copper is removed from the cathode by a suitable device and collected in a container under the cathode and under the inlet. Since the solution containing Fe(III) ions is continuously fed from the treatment chamber, a re-dissolving of the copper would be initiated. This is prevented by applying a potential of more than 0.35 V to the collecting tray and, thus, to the copper.

Figure 3:
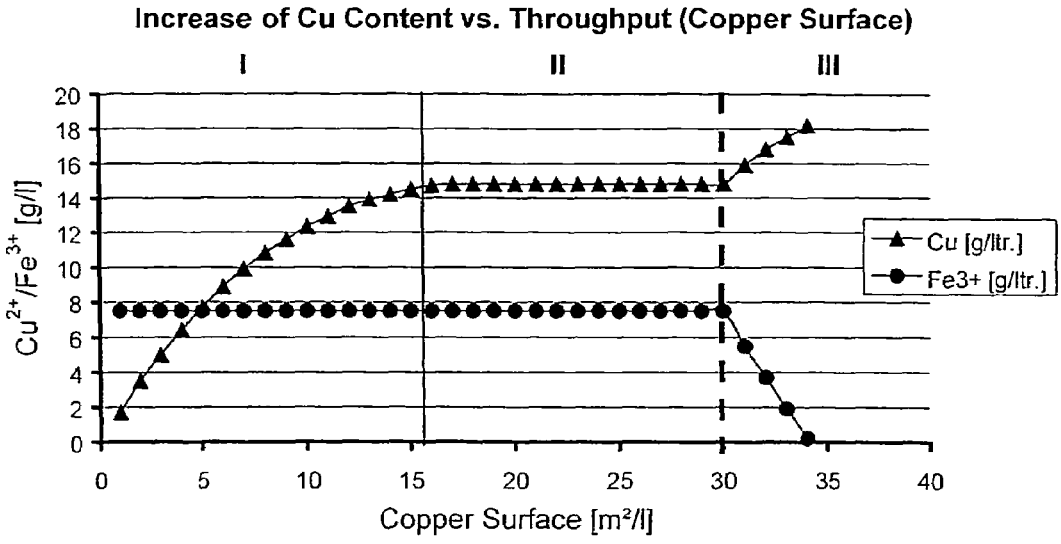
FIG. 3 is the schematic representation of the graphs of the concentration of Fe(III) and Cu(II) as a function of the treated copper surface, respectively.

FIG. 3 illustrates the graph of the concentrations of Fe(III) and Cu(II) in the etching chamber as a function of the treated copper surface. Since the horizontal system used herein was operated at a speed of 2 m/min (60 m$^2$/h cut-off), this representation corresponds to a function of time. The apparatus according to the present invention was operated at an anodic current density of 40 A/dm$^2$ and at a cathodic current density of 20 A/dm$^2$. The container for the treatment solution had a volume of 560 litres.

In Segment I of FIG. 3 the cathodic current efficiency is not sufficient; in Segment II there is an equilibrium between the etched amount of copper and the cathodic depositing of copper; Segment III relates to the time after turning off the means for keeping the etching rate constant. It can be clearly seen that the pre-determined Fe(III) concentration of about 7.5 g/l is maintained throughout the operation time of the regeneration unit. Moreover, it is evident how the content of Cu(II) increases and levels to about 15 gA. In this equilibrium state the same amount of copper is etched from the material to be treated (etching rate 1 μm/min Cu, time 1 min) as is deposited in the regeneration unit. If the unit is turned off (at 30 m$^2$/ltr.), the content of Cu(II) increases again, while the concentration of Fe(III) decreases and, thus, the operation range is left.

The electrolysis can be carried out using both direct current and pulsed current. Optionally, the current density can be selected at a level at which $O_2$ or $Cl_2$ are developed. Since $O_2$ and $Cl_2$ cannot escape from the closed system, it is available for the oxidation of excess Fe(II).

Therefore, no diaphragms or ion exchange membranes are necessary and the efficiency of the re-oxidation is raised to a level, at which only a single cell having a small surface of the anode is necessary.

Additionally to the significantly lengthened operation time of the etching solution, during which no new preparation becomes necessary, there is the further advantage that no two-step pre-cleaning is necessary, if an etching solution containing iron and having suitable wetting agents is used. Thereby, the required number of systems in one site or the required number of treatment steps is reduced leading to a reduction of expenses.

LIST OF NUMERALS

1 cathode
2 anode
3 means for removing electrolytically deposited copper
4 means for applying a potential to the removed copper
5 inlet
6 outlet
7 valve
8 anode hood

The invention claimed is:

1. Method for regenerating from an etching system an etching solution containing iron for the use in etching or pickling copper or copper alloys, comprising:

(i) feeding the etching solution to be regenerated from the etching system into an electrolysis cell comprising a cathode, an inert anode, means for removing the electrolytically deposited copper from the cathode and means for collecting the removed copper and applying a potential to the removed copper, wherein the electrolysis cell does not have an ion exchange membrane or a diaphragm, wherein the electrolysis cell is constructed to channel the etching solution such that the solution contacts the cathode of the electrolysis cell first, and then contacts the anode, and then exits the electrolysis cell, and wherein the electroylsis cell is a closed system which prevents gas from escaping from the solution;

(ii) electrolytically depositing the copper comprised in the etching solution at the cathode, (iii) oxidising the Fe(II) comprised in the etching solution to Fe(III) at the anode, (iv) removing the copper deposited at the cathode, (v) applying a potential to the removed copper to prevent re-dissolving of the copper, and (vi) returning the etching solution being thus treated to the etching system.

2. Method according to claim 1, further comprising controlling the flow of the etching solution through the electrolysis cell and/or the current flowing through the electrolysis cell by use of on-line measuring of the concentration of Fe(II)/Fe (III) or the concentration of Cu.

3. Method according to claim 2, wherein the on-line measuring of the concentration of Cu is carried out by photometric methods or by potentiometric measurement.

4. Method according to claim 1, wherein the electrolysis is carried out in the electrolysis cell using direct current.

5. Method according to claim 1, wherein the electrolysis is carried out in the electrolysis cell using pulsed current.

6. Apparatus for regenerating an etching solution containing iron for the use in etching or pickling copper or copper alloys comprising:

(i) a separate electrolysis cell comprising a cathode and an inert anode, means for removing the electrolytically deposited copper from the cathode, means for collecting the removed copper and for applying a potential to the removed copper, wherein the electroylsis cell is a closed system which prevents gas from escaping the solution, (ii) an inlet in the lower region of the electrolysis cell between the cathode and the means for collecting the removed copper, and (iii) an outlet, wherein the electolysis cell is constructed such that the solution contacts the cathode first and then contacts the anode, and then exits the electrolysis cell, and wherein the electrolysis cell does not have an ion exchange membrane or a diaphragm.

7. Apparatus according to claim 6, further having valves for discharging the removed copper.

8. Apparatus according to claim 6, wherein the cathode is in the form of a rotating cathode and the means is in the form of a stripping plate.

9. System for etching or pickling of work pieces comprising an apparatus according to claim 6.

10. Apparatus according to claim 6 further comprising an over-pressure valve.

* * * * *